United States Patent [19]

Sleger

[11] 4,044,323

[45] Aug. 23, 1977

[54] DAMPED SOLENOID

[75] Inventor: Roger R. Sleger, Redwood City, Calif.

[73] Assignee: Ampex Corporation, Redwood City, Calif.

[21] Appl. No.: 682,455

[22] Filed: May 3, 1976

[51] Int. Cl.[2] ..... H01H 51/08

[52] U.S. Cl. ..... 335/240; 360/105

[58] Field of Search ..... 335/61, 239, 240; 360/105

[56] References Cited

U.S. PATENT DOCUMENTS

| | | | |
|---|---|---|---|
| 3,656,076 | 4/1972 | Prouty et al. | 335/240 |
| 3,805,203 | 4/1974 | Deckard | 335/239 |
| 3,943,476 | 3/1976 | Iyeta | 335/240 X |

*Primary Examiner*—George Harris

*Attorney, Agent, or Firm*—Charles M. Carman, Jr.

[57] ABSTRACT

To slow down the action of a solenoid for use in moving delicate mechanisms, or other time-delay uses, the solenoid frame is provided with a closed end, vented only by a restricted orifice, and the solenoid plunger is fitted with a pressure seal to ensure venting of trapped air only through the restricted orifice.

5 Claims, 2 Drawing Figures

DAMPED SOLENOID

BACKGROUND OF THE INVENTION

This invention relates to solenoids, and particularly to damping arrangements for such solenoids.

There are a number of applications for slow-acting electromagnetic actuators which at the present time can be satisfied only by devices that are inordinately expensive for the results desired. In the magnetic disc and drum recording art, for example, it is usually desired to start the high inertia disc or drum and bring it slowly up to speed with the delicate transducing heads lifted or withdrawn from the recording surface, and then to lower the heads to the surface very gradually so as to avoid impact or "crash" damage to both head and surface. Solenoids have been used, as exemplified by U.S. Pat. Nos. 3,180,943 and 3,005,676, but only in environments where an air bearing can be expected to form and cushion the approach of the head to the recording surface, or alternatively, only in conjunction with cumbersome and space-filling damping means for slowing the solenoid action; or by the use of expensive timing motors (U.S. Pat. Nos. 3,855,623 and 3,870,835), the cost of which is out of proportion to the importance of the function performed. The same objections apply to prior art equipment of commercial availability in the magnetic tape-lifting art; that is to say, in the art of lifting magnetic tape away from delicate transducing heads during fast forward or rewind operation of the tape reels so as to avoid undue abrasion and wear of the head surfaces, and of the tape itself.

In the solenoid art, ways have been found to slow the plunger action. For example, external dash pots have been coupled to such solenoids, but at the expense of using valuable space that might have been much better devoted to other uses. Likewise, solenoids have been devised with restricted orifices for the plunger cavity; see for example those produced by the Regdon Corporation of Brookfield, Illinois. However, the slowest times obtainable in such devices are in the order of fifths of a second or less, whereas in the head-lifting and tape-lifting arts, periods many times longer are needed to avoid damage to the heads and recording elements.

Accordingly, it is an object of this invention to provide a damped linear solenoid of the restricted-orifice type, having improved time-delay operating characteristics.

BRIEF DESCRIPTION OF THE INVENTION

This and other objects are accomplished by the present invention in which to slow down the action of a solenoid for use in moving delicate mechanisms, or other time-delay uses, the solenoid frame is provided with a closed end, vented only by a restricted orifice, and the solenoid plunger is fitted with a pressure seal to ensure venting of trapped air only through the restricted orifice.

DESCRIPTION OF THE PREFERRED EMBODIMENTS

Figure 1:
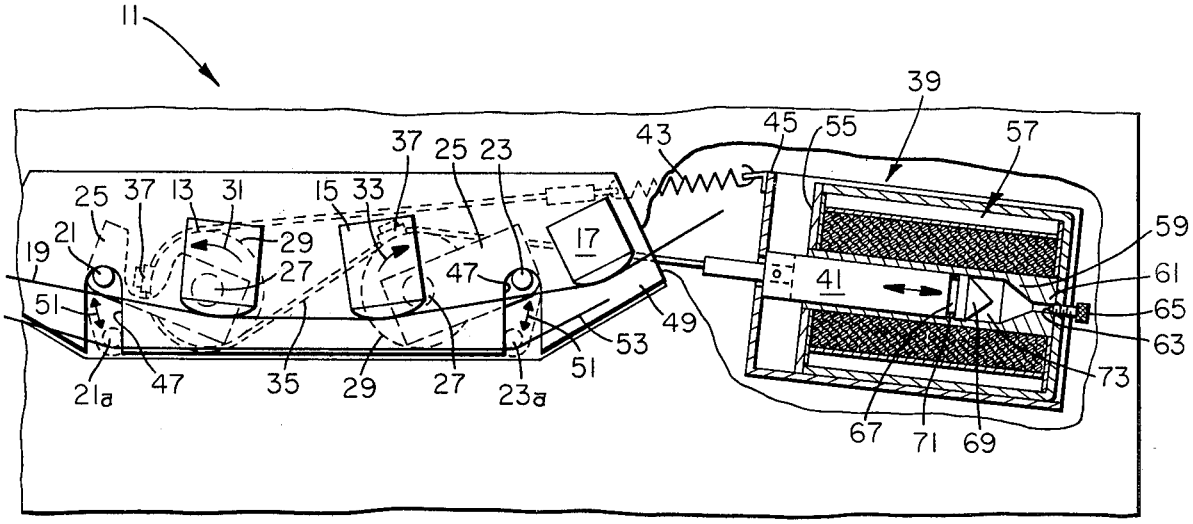
FIG. 1 is a plan view, partly broken away and in section, of apparatus embodying the invention.

Referring to FIG. 1, there is shown a portion of a magnetic tape transport 11 including three magnetic transducing heads 13, 15 and 17, across which a magnetic tape 19 is tensioned and moved as by reels, capstans and other means well known in the art and not here shown. Such movement is engagement with the heads is desired during recording and replay modes, but for fast forward and fast reverse (rewind) modes it is usually desirable to lift the tape away from contact with the heads so as to avoid wear and abrasion of both head and tape.

To provide lifting action for the tape, a pair of pivoting guide pins 21, 23 are provided, each projecting upward from a recessed position between the heads during play-record modes. Each pin 21, 23 is mounted on an arm 25 which extends from and pivots on a shaft 27; each shaft having a pulley 29 affixed thereto, and the pulleys being operable in opposite rotational directions, as illustrated by arrows 31, 33 by means of a common pull-cord 35 that is clamped to the pulley rims by clamps 37. To actuate the pulleys for pivoting in the directions of arrows 31, 33 there is provided a linear solenoid 39, to the plunger 41 of which one end of the cord 35 is attached; and to return the pulleys and pins 21, 23 to recessed position, there is provided a return spring 43 anchored to the housing 45 of solenoid 39 and attached to the other end of cord 35. It will be seen that in the recessed position, pins 21, 23 are nestled into and stopped by the ends of slots 47 formed in a head mounting plate 49, and in movement to the dashed-line head-lifting position 21*a*, 23*a* as illustrated by arrows 51, they lift the tape completely away from the heads and to a path illustrated by line 53.

A major problem in moving the tape to the lifted position is that solenoids of the type ordinarily commercially available operate too rapidly and with excessive shock action, which can produce excessive tape tension variations, and undesirable audible noise. On servoed tape machines this shock can cause servo instability.

Accordingly, the solenoid 39 of the present invention has been provided not only with a standard frame 55 and electromagnetic coil 57, but also with a modified magnetic core 59, and a modified plunger 41, as follows.

First, the dead end of core 59, through which the plunger never projects, is substantially closed off by a wall 61 having a central threaded bore 63 therein, into which is threaded a bolt 65. This assembly constitutes a very long time-delay restricted orifice in that air under pressure can escape through the bore 63 only by passing between the meshed screw threads of the bore and bolt 65. The bolt may be turned to seat more or less deeply in the threaded bore 63 to vary the time delay produced.

Figure 2:
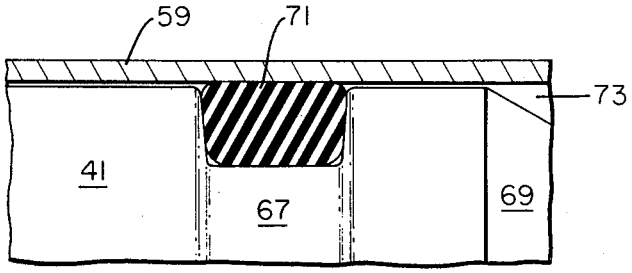
FIG. 2 is an enlarged fragmentary view of a portion of the apparatus shown in FIG. 1.

To ensure that the full time delay provided by bolt 65 is utilized, the plunger 41 is provided with an encircling O-ring groove 67, near the head 69 thereof, and an O-ring 71 (see also FIG. 2) is seated in the groove 67 so as to effectively seal the comparatively loose radial space between plunger 41 and armature 59 against the escape of air trapped in the chamber 73 when the plunger begins to close. Plunger and chamber can be given conically tapered ends, the taper of the plunger being slightly more obtuse to avoid sticking.

With structure such as that described gentle actuation of the tape lifters 21, 23 has been achieved stretching over a time period as long as one or two seconds, or substantially as long as may be desired, with suitable design of the shapes and dimensions embodied therein.

It will be understood that the invention includes not only the structure illustrated, with a chamber 73 at one end, vented by a restricted orifice, but also structure in which chambers are defined between the plunger and the armature in any or even many parts of the solenoid; such as either or both ends and/or the middle, such chambers being vented by restricted orifices formed in any part of the solenoid; and also to solenoids that are not linear but rotating, or in any other form.

Thus there has been described structure wherein to slow down the action of a solenoid for use in moving delicate mechanisms, or other time-delay uses, the solenoid frame is provided with a closed end, vented only by a restricted orifice, and the solenoid plunger is fitted with a pressure seal to ensure venting of trapped air only through the restricted orifice.

I claim:

1. A damped solenoid, comprising:

a first magnetizable member having an opening formed therein and a second magnetic movable member fitting within said opening, together with means for magnetizing said first member to move said second member between first and second positions with respect to said first member;

said first member and said second member having confronting portions defining a chamber vented by a restricted orifice; and pressure sealing means disposed between said first member and said second member to ensure control of the operating speed of said solenoid by said restricted orifice.

2. A solenoid as recited in claim 1, wherein said first member is the tubular armature of an electromagnetic coil and said second member is a plunger reciprocating therein.

3. A solenoid as recited in claim 2, wherein said chamber is defined at one end of said tubular armature, said end being substantially closed to define said orifice venting said chamber.

4. A solenoid as recited in claim 3, wherein said plunger is provided with a circumferential groove and an O-ring seal is disposed within said groove to seal said chamber against escape of air except through said orifice.

5. A solenoid as recited in claim 1, wherein said orifice is defined as a threaded bore containing a threaded bolt to permit passage of air only between the threaded portions of said bore and bolt, said bolt being rotatable to vary the effective resistance of said restricted orifice.

* * * * *